US012595147B2

(12) United States Patent
Hender

(10) Patent No.: US 12,595,147 B2
(45) Date of Patent: Apr. 7, 2026

(54) WEB GUIDES WITH SELECTIVELY PROTRUDING FINS

(71) Applicant: Heather Hender, Portland, OR (US)

(72) Inventor: Heather Hender, Portland, OR (US)

( * ) Notice: Subject to any disclaimer, the term of this patent is extended or adjusted under 35 U.S.C. 154(b) by 0 days.

(21) Appl. No.: 19/073,961

(22) Filed: Mar. 7, 2025

(65) Prior Publication Data

US 2025/0206557 A1 Jun. 26, 2025

(51) Int. Cl.
*B65H 23/032* (2006.01)
*B65H 23/038* (2006.01)
*B65H 27/00* (2006.01)

(52) U.S. Cl.
CPC ..... *B65H 23/0322* (2013.01); *B65H 23/038* (2013.01); *B65H 27/00* (2013.01); *B65H 2404/112* (2013.01)

(58) Field of Classification Search
CPC .. B65H 23/0322; B65H 23/038; B65H 27/00; B65H 23/032; B65H 75/24; B65H 75/242; B65H 75/248; B65H 75/2484; B65H 75/2487
See application file for complete search history.

(56) References Cited

U.S. PATENT DOCUMENTS 2,120,735 A 6/1938 Debrie
2,814,484 A 11/1957 Stobb
2,817,940 A * 12/1957 Lorig ..... B65H 23/02 492/47
2,904,278 A * 9/1959 Riemenschneider ..... B65H 75/2487 279/35
3,411,683 A * 11/1968 Bartles ..... D06C 3/00 226/190
3,760,855 A 9/1973 Nilberg
3,784,076 A * 1/1974 Avery ..... B65H 23/02 226/190
4,253,392 A * 3/1981 Brandon ..... G03G 15/2053 100/327
4,469,288 A * 9/1984 Pontes ..... B65H 75/2484 242/576
5,000,364 A * 3/1991 Thimon ..... B65H 23/025 226/189
5,035,037 A 7/1991 Sprung
(Continued)

FOREIGN PATENT DOCUMENTS

CN 114890242 A * 8/2022 ..... B65H 75/242

*Primary Examiner* — Victoria P Augustine
*Assistant Examiner* — Katelynne R Burrell
(74) *Attorney, Agent, or Firm* — Mohr Intellectual Property Law Solutions, PC

(57) ABSTRACT

Web guides including a roller, a control surface assembly, and a fin actuator. The roller is configured to mount to a drive shaft. The roller includes a tube wall. The tube wall defines an interior space, an exterior surface, and slots. The slots are circumferentially spaced around the tube wall. The slots pass through the tube wall from the interior space to the exterior surface. The control surface assembly is disposed within the interior space. The control surface assembly includes fins. The fins are aligned with the slots and adapted to selectively move between a retracted position contained within the roller and an extended position protruding beyond the exterior surface of the roller. The fin actuator is configured to selectively move the fins between the retracted position and the extended position.

19 Claims, 10 Drawing Sheets

(56) References Cited

U.S. PATENT DOCUMENTS

| | | | | |
|---|---|---|---|---|
| 5,252,991 | A * | 10/1993 | Storlie | G02B 26/12 250/236 |
| 5,310,106 | A * | 5/1994 | Thimon | B65H 23/26 226/189 |
| 5,522,785 | A | 6/1996 | Kedi | |
| 5,599,015 | A | 2/1997 | Shimizu | |
| 5,846,177 | A | 12/1998 | Mayr | |
| 6,110,093 | A | 8/2000 | Slusarz | |
| 6,546,867 | B1 | 4/2003 | Franklin | |
| 6,550,656 | B2 * | 4/2003 | Kurz | B65H 23/038 226/19 |
| 6,635,895 | B2 * | 10/2003 | Haque | B65H 23/0216 356/637 |
| 9,028,036 | B1 * | 5/2015 | Bildstein | B65H 23/038 347/19 |
| 2001/0023883 | A1 * | 9/2001 | Kurz | B65H 27/00 226/19 |
| 2007/0293381 | A1 * | 12/2007 | Uusitalo | D21F 1/40 492/16 |
| 2012/0066986 | A1 | 3/2012 | Dicleli | |
| 2013/0108334 | A1 | 5/2013 | deJong | |
| 2015/0210497 | A1 * | 7/2015 | Zhou | D06C 3/06 26/99 |
| 2024/0158196 | A1 * | 5/2024 | Yang | B65H 27/00 |

* cited by examiner

WEB GUIDES WITH SELECTIVELY PROTRUDING FINS

BACKGROUND

The present disclosure relates generally to web guides. In particular, web guides with selectively protruding fins are described.

Web guides are used in web processing machines (hereinafter web machines). Web guides are also used in web or belt conveyance systems. Conveyor belts used in warehouses, factories, farms, and job sites are examples of web conveyance systems that utilize web guides. Airports and shipping facilities also make extensive use of web conveyance systems and web guides to move packages and luggage efficiently.

Web machines manipulate webs of media in various ways. A printing press is one example of a web machine. A printing press moves a web of paper at high speed and prints information on the paper.

A wide variety of webs may be processed in web machines. For example, some web machines process battery separator film or polyethylene terephthalate (PET) film. Web machines are also utilized to manufacture roofing shingles.

A belt sander is an example of a closed-loop web machine. A belt sander moves a web in the form of an abrasive belt over rollers in a closed-loop. Belt sanders enable workpieces to be sanded by the moving belt. A treadmill exercise device is another example of a closed-loop web machine.

Guiding the web moved by the web machine is necessary. Guiding the web maintains the web moving in a desired path and/or adjusts the desired path of the web. The web deviating from a desired path can cause the web machine to malfunction, can increase wear on the web, and/or can reduce the accuracy or effectiveness of how the web is processed. For example, printing may be misaligned if paper is not maintained in a desired path in a printing press.

Known web guides, such as sheet weave guides, lateral roller motion guides, or offset pivot roller guides, are not entirely satisfactory for the range of applications in which they are employed. For example, conventional web guides do not provide adequate means to dynamically change the effective diameter of a web guide roller. The inability to dynamically change the effective diameter of a roller limits the ability of conventional web guides to quickly alter the tension in the web to dynamically guide the web. It would be beneficial to have a web guide that enabled dynamically changing the effective diameter of a roller to enable swiftly counteracting changes in how a web is tracking within a web machine.

Further, existing web guides are undesirably complex, insufficiently reliable, and/or expensive. It would be desirable to have an improved and cost-effective web guide that effectively guided webs with a relatively simple, fast-responding mechanism.

The relatively large size of conventional web guides is less than ideal. Accommodating large web guides in web machines presents engineering challenges and can limit where conventional web guides or web machines with large conventional web guides installed may be used. It would be advantageous to have a relatively small and compact web guide that could be readily used in web machines without size-related constraints and engineering challenges.

Thus, there exists a need for web guides that improve upon and advance the design of known web guides.

Examples of new and useful web guides relevant to the needs existing in the field are discussed below.

Examples of references relevant to web guides include U.S. Pat. Nos. 6,546,867B1, 6,110,093A, 5,522,785A, US20130108334A1, US 20120066986A1, U.S. Pat. Nos. 5,846,177A, 5,599,015A, 5,035,037A, 2,814,484A, 2,120,735A, and 3,760,855A. The complete disclosures of the above patents and patent applications are herein incorporated by reference for all purposes.

SUMMARY

The present disclosure is directed to web guides including a roller, a control surface assembly, and a fin actuator. The roller is configured to mount to a drive shaft. The roller includes a tube wall.

The tube wall defines an interior space, an exterior surface, and slots. The slots are circumferentially spaced around the tube wall. The slots pass through the tube wall from the interior space to the exterior surface.

The control surface assembly is disposed within the interior space. The control surface assembly includes fins. The fins are aligned with the slots and adapted to selectively move between a retracted position contained within the roller and an extended position protruding beyond the exterior surface of the roller.

The fin actuator is configured to selectively move the fins between the retracted position and the extended position.

DETAILED DESCRIPTION

Figure 1:
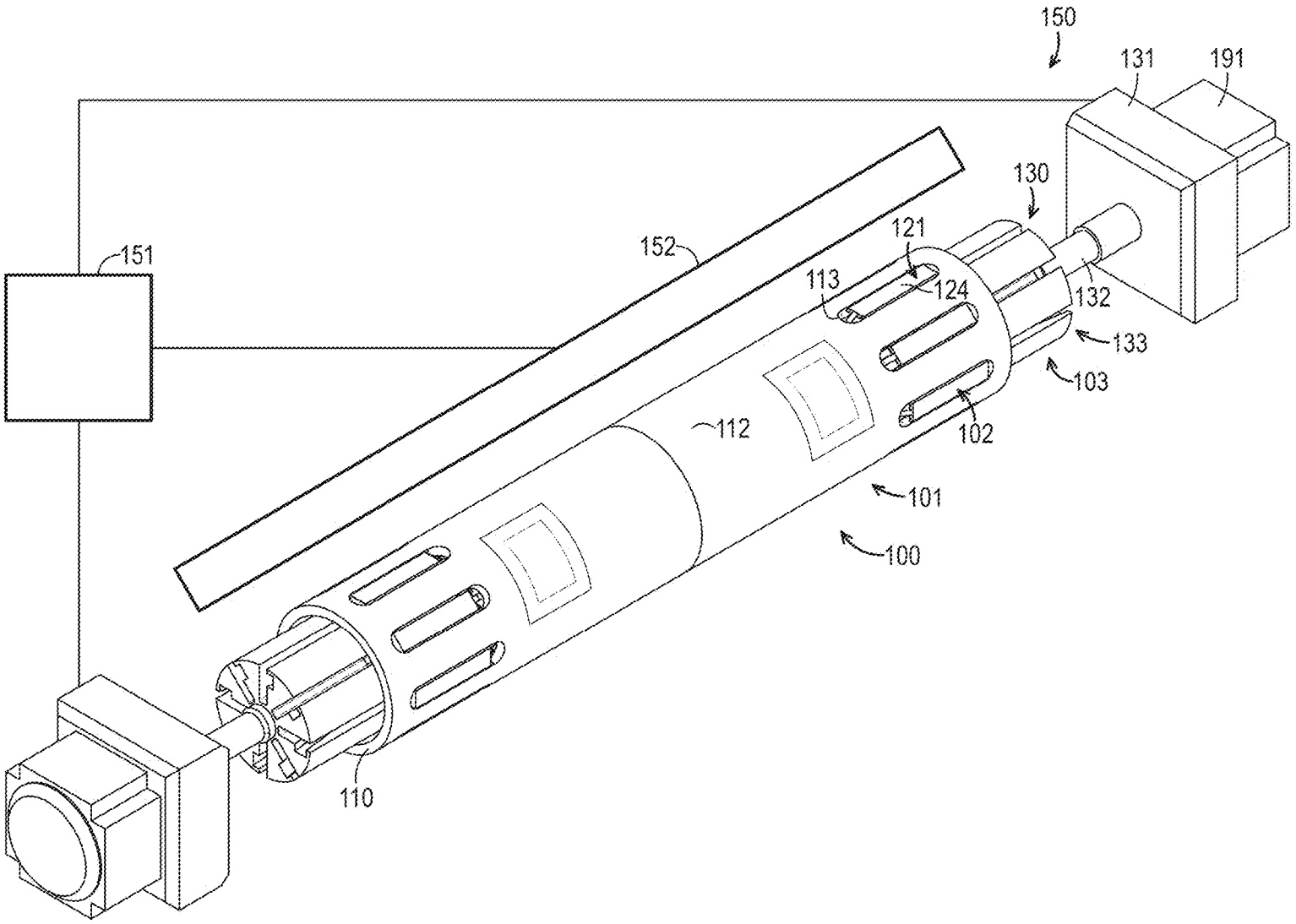
FIG. 1 is a perspective view of a first example of two web guides assembled together as a part of a web guide system.

The disclosed web guides will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various web guides are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Communicatively coupled" means that an electronic device exchanges information with another electronic device, either wirelessly or with a wire-based connector, whether directly or indirectly through a communication network.

"Controllably coupled" means that an electronic device controls operation of another electronic device.

Contextual Details

Ancillary features relevant to the web guides described herein will first be described to provide context and to aid discussing the web guides.

Web and Web Machines

The web guides discussed in this document function to guide webs in web machines. Webs may be described as media, material, or substrates. The web guided by the web guides described below may be any currently known or later developed type of web, such as belts or rolls of paper or other substrates, such as tape, film, foil, and the like. The web guides may be used to guide webs in any currently known or later developed type of web machine, such as printing presses, battery separator film processing machines, or PET film machines, machines to produce roofing shingles, belt sanders, and treadmills.

Webs typically move through a web machine in a continuous or substantially continuous manner. For example, a web may be an abrasive belt that forms a continuous, closed loop within a belt sander web machine. Examples of substantially continuous webs are rolls of paper that pass through a printing press or rolls of film that pass through film processing machines.

The web guides described herein may also be used in web or belt conveyance systems. Suitable web conveyance system applications for the presently described web guides include conveyor belts used in warehouses, factories, farms, job sites, airports, and shipping facilities.

Web Guides with Selectively Protruding Fins

With reference to the figures, web guides with selectively protruding fins will now be described. The web guides discussed herein function to guide webs passing through web machines.

The reader will appreciate that the devices disclosed herein have applications beyond guiding webs in web guide machines. For example, the devices and mechanisms described in this document may be used for steering vehicles, such as slower moving vehicles typically used in warehouses. The presently disclosed devices may be used in any application where dynamically changing the effective diameter of a roller or cylinder would be useful.

The reader will appreciate from the figures and description below that the presently disclosed web guides address many of the shortcomings of conventional web guides. For example, the novel web guides discussed herein enable dynamically changing the effective diameter of a web guide roller. As a result, the novel web guides are capable of quickly altering the tension in the web to dynamically guide the web. Beneficially, the novel web guides enable swiftly counteracting changes in how a web is tracking within a web machine.

Further, the novel web guides avoid the complexity, reliability issues, and expense of conventional web guides. Desirably, the novel web guides are cost-effective and reliably guide webs with a relatively simple, fast-responding mechanism. Advantageously, the novel web guides discussed below have a relatively small and compact footprint, which makes them suitable for ready use in web machines without size-related constraints or engineering challenges often present with large web guides.

Web Guide Embodiment One

Figure 8:
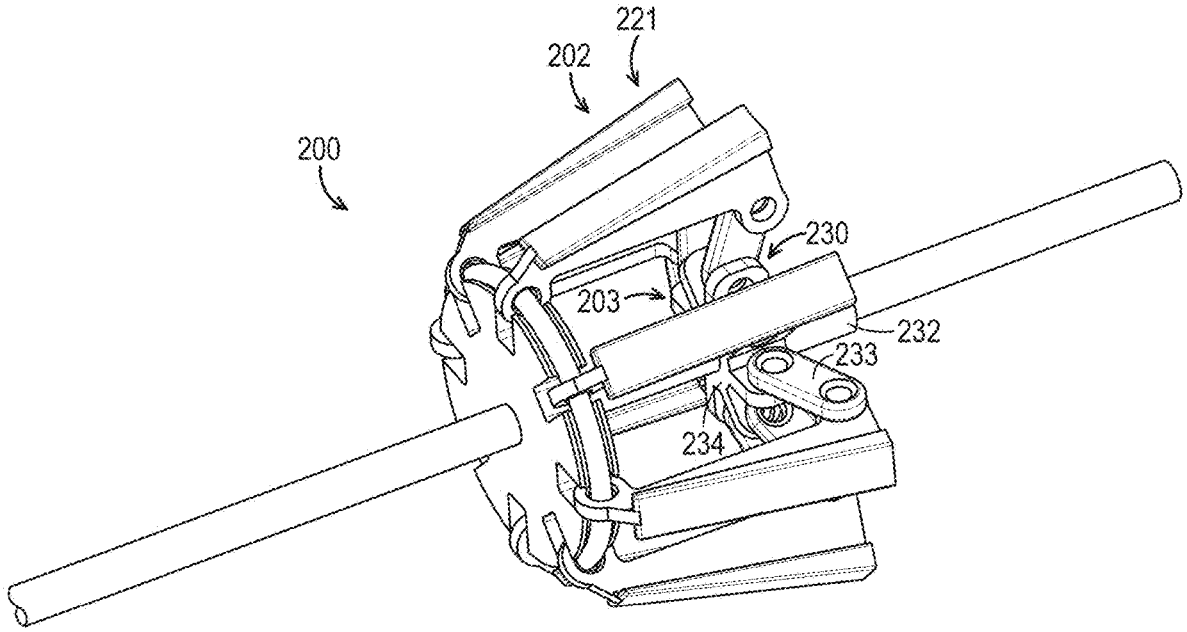
FIG. 8 is a perspective view of a second example of a web guide, which includes pivoting links to raise and lower fins.
Figure 9:
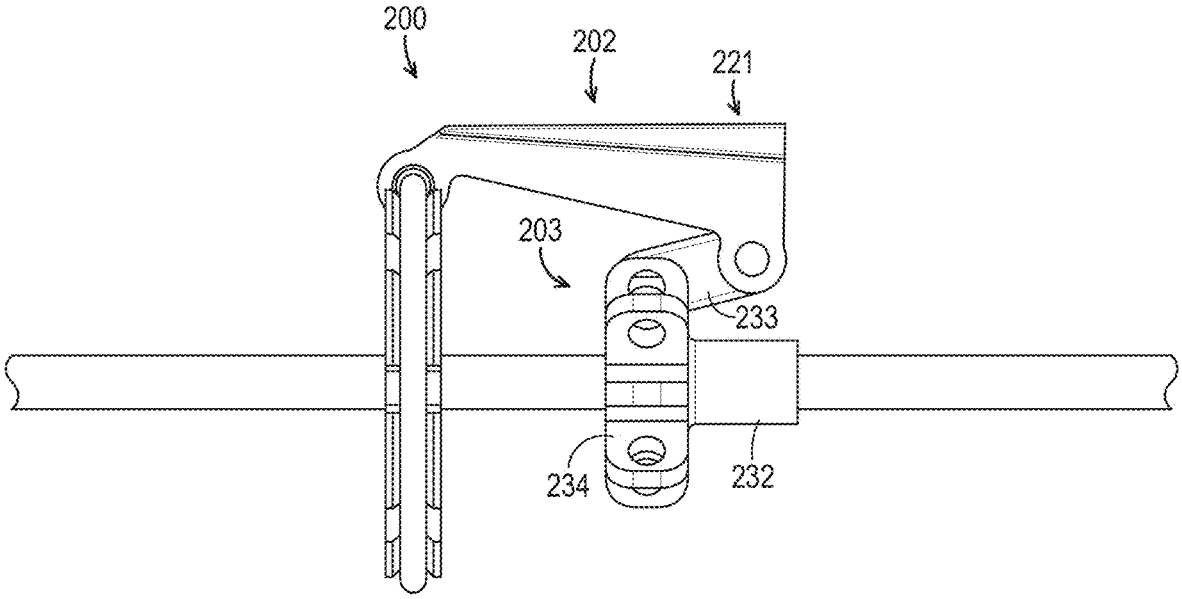
FIG. 9 is a side elevation view of the web guide shown in FIG. 8 with a link lowering a fin and other links and fins removed for clarity.
Figure 10:
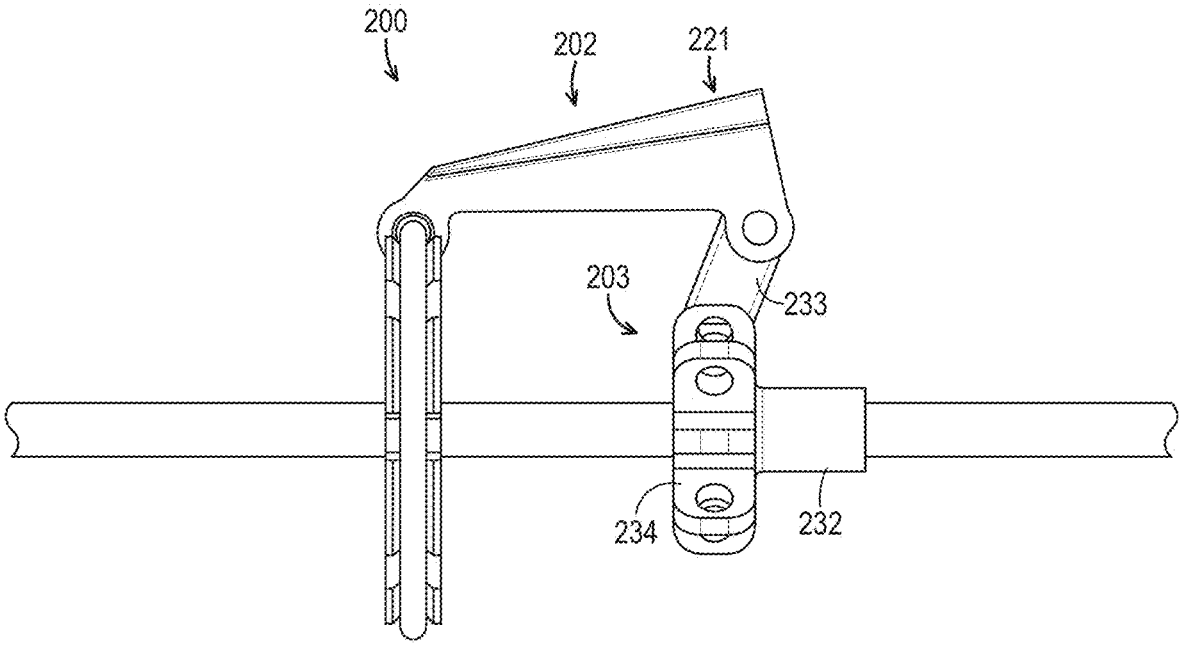
FIG. 10 is a side elevation view of the web guide shown in FIG. 8 with a link raising the fin and other links and fins removed for clarity.

With reference to FIGS. 1-7, a first example of a web guide, web guide 100, will now be described. A second example of a web guide, web guide 200, is shown in FIGS. 8-10 and discussed in the Embodiment Two section below. Web guides 100 and 200 both function to guide a web within a web machine by dynamically changing the effective diameter of a control surface in contact with the web.

Web guide 100 includes a roller 101, a control surface assembly 102, and a fin actuator 103. In some examples, the web guide does not include one or more features included in web guide 100. In other examples, the web guide includes additional or alternative features. The components of web guide 100 are discussed in the sections below.

As shown in FIG. 1, web guide 100 may be part of a web guide system 150. Web guide system 150 includes web guide 100, a control unit 151, and a web sensor 152. Web guide systems utilizing web guides according to the present disclosure may include fewer, additional, or alternative components than control unit 151 and web sensor 152 depicted in FIG. 1.

The size and shape of the web guide may differ than the example shown in FIGS. 1-7. The reader should understand that different webs and web machines may indicate that a different size or shape web guide with the features and capabilities discussed herein should be used.

The number of web guides employed will vary in different applications. In some instances, a single web guide is effective to guide a web. As shown in FIG. 1, two axially aligned web guides 100 may be used to guide a web from opposite lateral sides of the web. In some applications, three or more web guides cooperate to guide a web.

In the example depicted in FIG. 1, each web guide 100 is configured the same. In other examples, the web guides may be configured differently. The discussion below will discuss one of the web guides 100 depicted in FIG. 1, and the reader should understand that the discussion pertains to the other web guide 100 depicted in FIG. 1 as well.

Roller

Roller 101 functions to support a web and drive a web when rotated by a drive shaft. In some examples, the roller is not driven by a motor and instead passively rotates while supporting a web passing over it. Roller 101 also functions to house control surface assembly 102 and to isolate fin actuator 103 from a web passing over roller 101.

With reference to FIG. 1, the reader can see that roller 101 is configured to mount to a drive shaft. The drive shaft is rotated by a motor 191. Roller 101 rotates to drive a web forward in response to the drive shaft rotating roller 101. In other examples, the roller is not coupled to a drive shaft or motor and does not actively drive a web forward. In such examples, the roller passively rotates in response to the web it supports moving over it.

Figure 2:
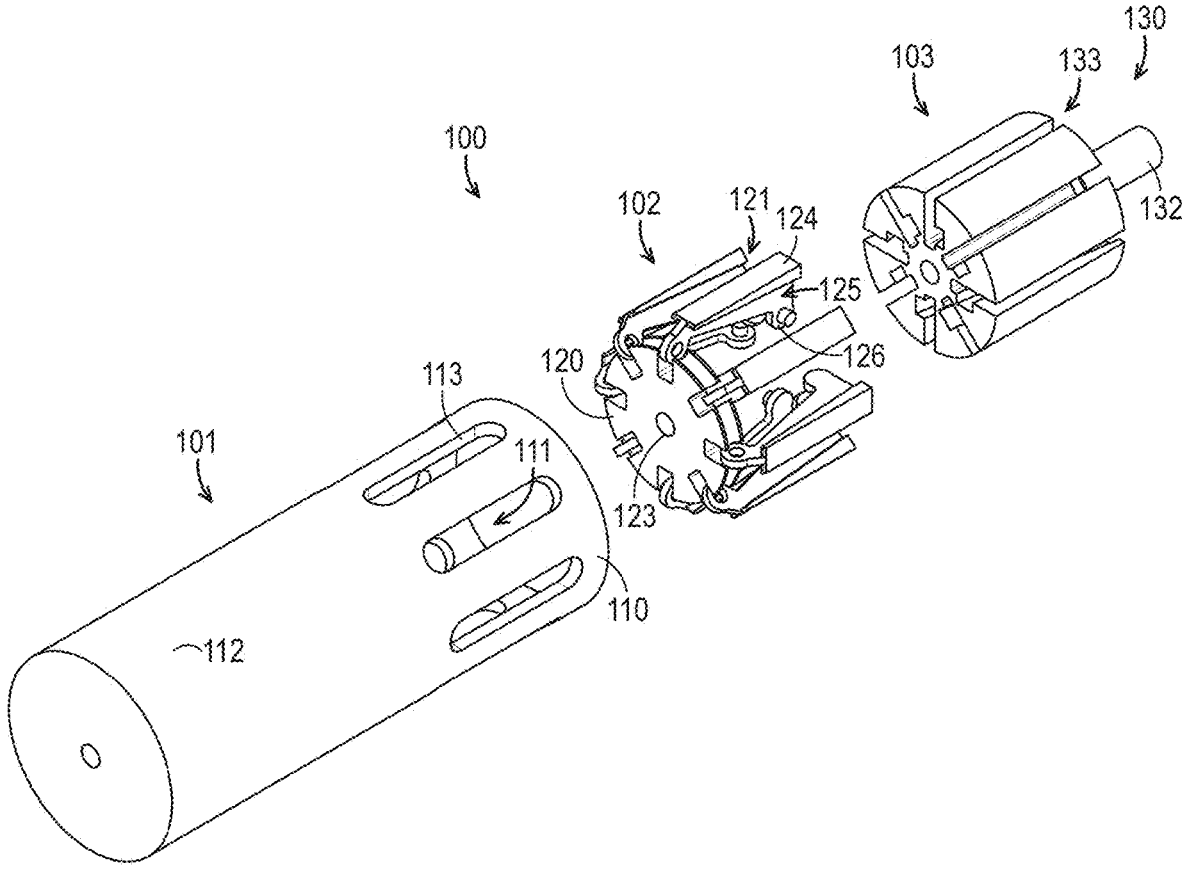
FIG. 2 is an exploded view of one of the web guides shown in FIG. 1 depicting a roller, a control surface assembly, and a fin actuator spaced apart from each other.
Figure 3:
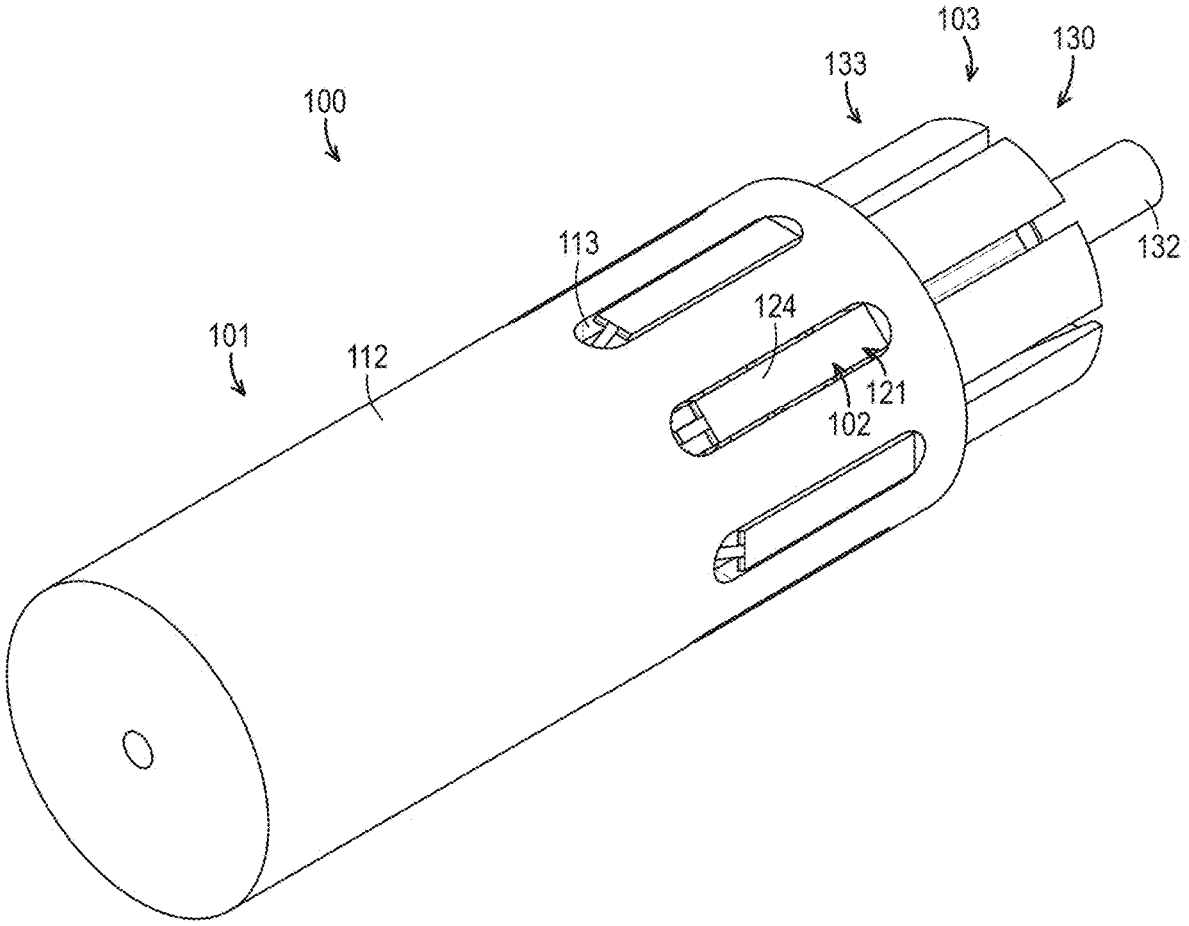
FIG. 3 is a perspective view of the web guide shown in FIG. 2 with the fin actuator retracted relative to the control surface assembly sufficient for fins of the control surface assembly to be contained within the roller below the surface of the roller.
Figure 4:
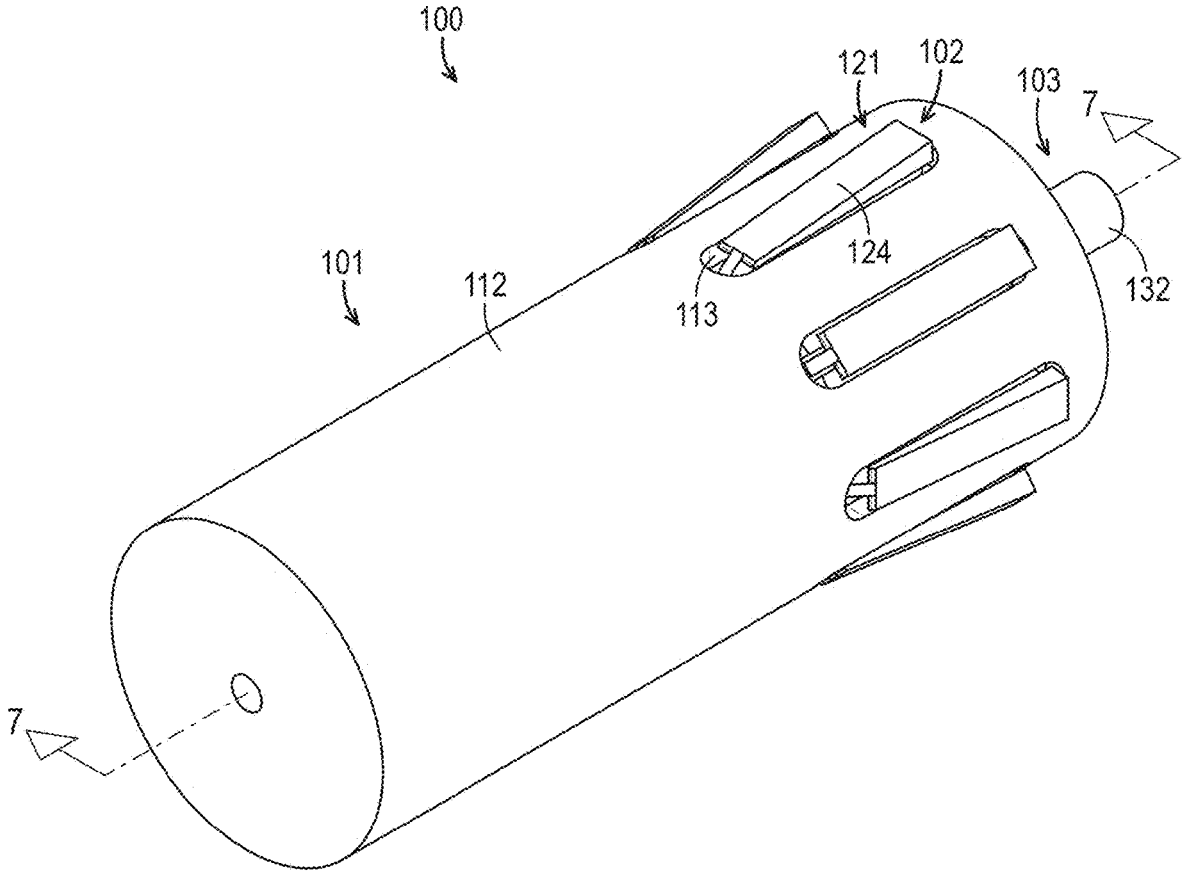
FIG. 4 is a perspective view of the web guide shown in FIG. 2 with the fin actuator extended toward the control surface assembly sufficient for fins of the control surface assembly to protrude beyond the surface of the roller.

As demonstrated in FIGS. 1-4 and 7, roller 101, control surface assembly 102, and fin actuator 103 are coaxially arranged. Control surface assembly 102 is radially disposed between roller 101 and fin actuator 103. As shown in FIGS. 3 and 4, fin actuator 103 is configured to move within roller 101 to variable extents.

As shown in FIGS. 1-4 and 7, roller 101 includes a tube wall 110. Tube wall 110 defines an interior space 111, an exterior surface 112, and slots 113. Interior space 111 receives control surface assembly 102 and a portion of fin assembly 103. The drive shaft also extends through interior space 111.

Exterior surface 112 adapted to be in contact with web moving through a web machine. Exterior surface 112 supports the web and drives the web forward when roller 101 rotates.

As apparent from FIGS. 1-4 and 7, slots 113 are circumferentially spaced around tube wall 110. Slots 113 pass through the tube wall 110 from interior space 111 to exterior surface 112.

FIGS. 3 and 4 demonstrate that slots 113 allow fins 121 of control surface assembly 102 to move between interior space 111 and an exterior space beyond exterior surface 112. Fins 121 selectively projecting above exterior surface 112 changes the effective diameter of web guide 100, which may be referred to as a variable effective diameter of roller 101. When fins 121 are contained within interior space 111, the effective diameter of web guide 100 is the exterior diameter of roller 101. When fins 121 project through slots 113 above exterior surface 112, the effective diameter of web guide 100 is the space between control surfaces 124 of fins 121 on opposite sides of roller 101.

Control Surface Assembly

Control surface assembly 102 functions to dynamically change the effective diameter of web guide 100. By changing the effective diameter of web guide 100, control surface assembly 102 functions to guide the web passing over roller 101 by modifying the tension in the web.

As shown in FIGS. 1-4 and 7, control surface assembly 102, roller 101, and fin actuator 103 are coaxially arranged. In particular, control surface assembly 102 is radially disposed between roller 101 and fin actuator 103. As apparent from FIGS. 1-4 and 7, control surface assembly 102 is disposed within interior space 111 of roller 101 underneath slots 113.

Figure 5:
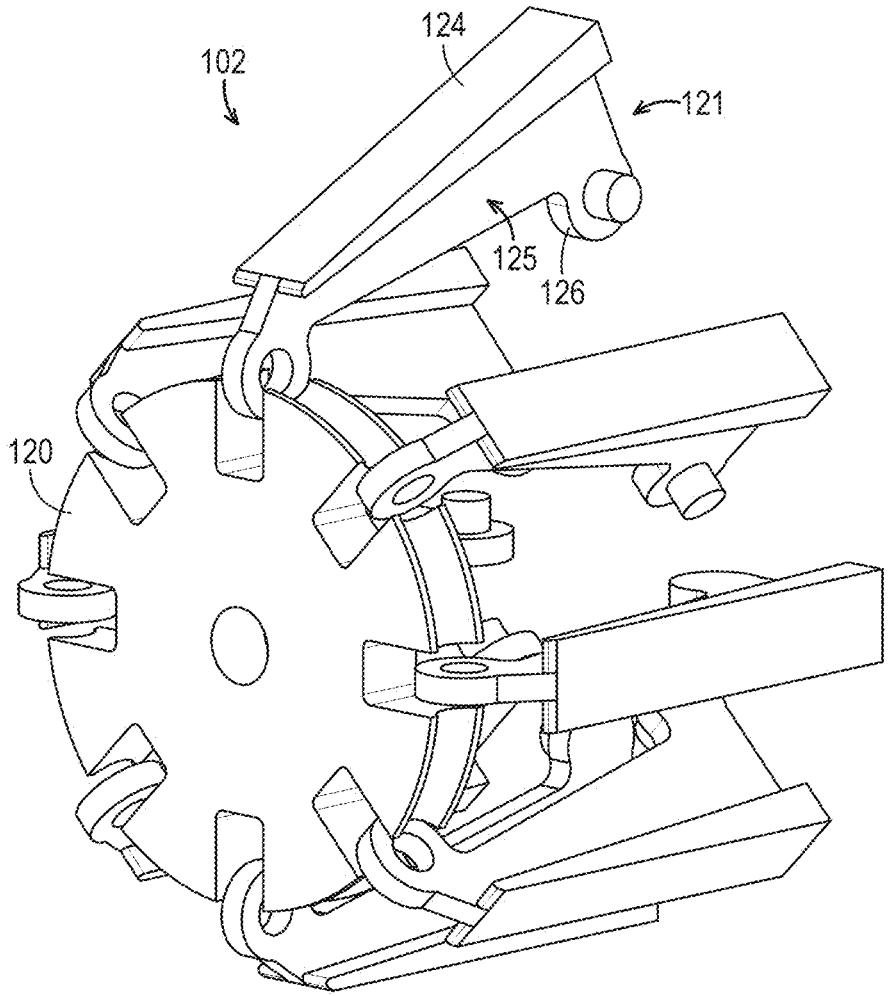
FIG. 5 is a perspective view of the control surface assembly of the web guide shown in FIG. 2 with a fin pivoted up relative to a base member.
Figure 6:
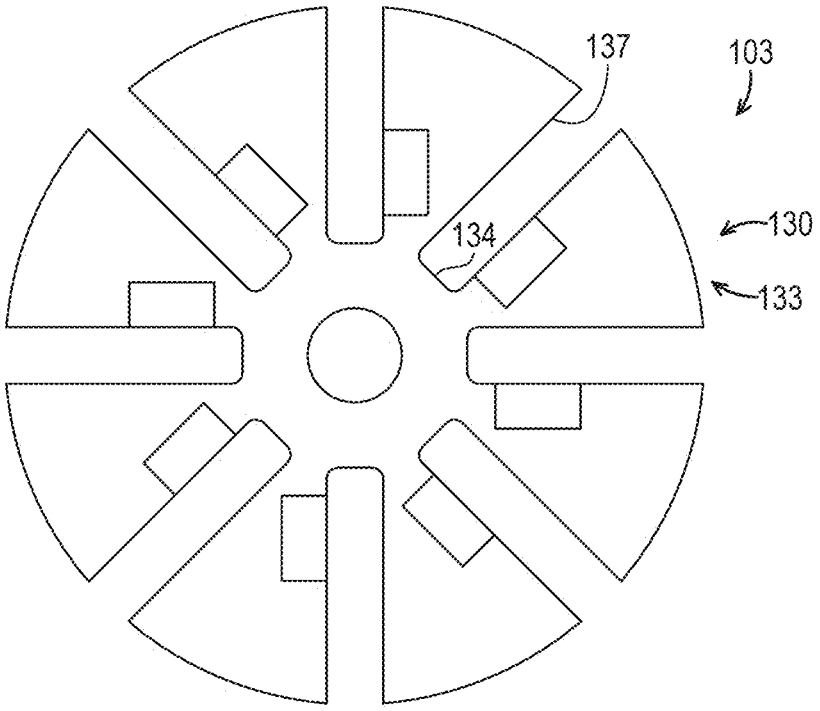
FIG. 6 is a front elevation view of the fin actuator of the web guide shown in FIG. 2.

With reference to FIGS. 2 and 5, the reader can see that control surface assembly 102 includes a base member 120 and fins 121. The components of control surface assembly 102 are described in the sections below.

Base Member

Base member 120 supports fins 121 and axially mounts control surface assembly 102 within roller 101. Base member 120 is disposed within interior space 111 closer to a longitudinal center of roller 101 than fins 121.

As shown in FIGS. 2 and 5, base member 120 is circular and oriented perpendicular to the longitudinal axis of roller 101. With continued reference to FIGS. 2 and 5, base member 120 defines a centerbore 123 adapted to receive and rest on an axial shaft. Base member 120 pivotally supports fins 121 around a circumference of base member 120.

Fins

Fins 121 function to interface with a web passing over roller 101. Fins 121 dynamically change the effective diameter of web guide 100. By changing the effective diameter of web guide 100, fins 121 guide the web passing over roller 101 by modifying the tension in the web.

As apparent in FIGS. 1-4, fins 121 are aligned with slots 113. Fins 121 are adapted to selectively move between a retracted position shown in FIG. 3 and an extended position shown in FIGS. 4 and 7. In the retracted position, fins 121 are contained within roller 101. In the extended position, fins 121 protrude beyond exterior surface 112 of roller 101.

Fins 121 include a control surface 124 facing away from the longitudinal axis of web guide 100. Control surfaces 124 are configured to engage a web when fins 121 are selectively pivoted beyond exterior surface 112 of roller 101. The extent to which fins 121 are pivoted beyond exterior surface 112 guides the web to a proportionate degree.

Fins 121 selectively projecting control surfaces 124 above exterior surface 112 changes the effective diameter of web guide 100, which may be referred to as a variable effective diameter of roller 101. When control surfaces 124 are contained within interior space 111 below exterior surface 112, the effective diameter of web guide 100 is the exterior diameter of roller 101. When control surfaces 124 project through slots 113 above exterior surface 112, the effective diameter of web guide 100 is the space between control surfaces 124 of fins 121 on opposite sides of roller 101.

Figure 7:
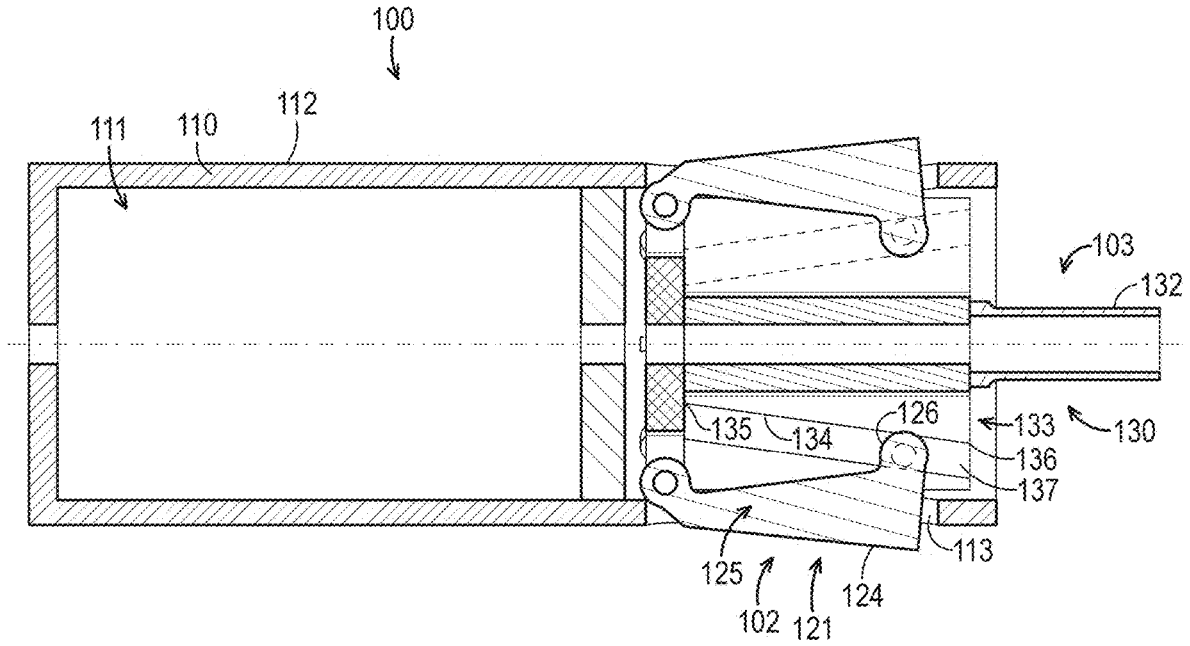
FIG. 7 is a side elevation, cross section view of the control surface assembly and the fin actuator of the web guide shown in FIG. 2 depicting lobes of fins resting on inclined guide surfaces of the fin actuator.

As shown in FIGS. 4 and 7, control surfaces 124 are oriented transverse to exterior surface 112 at a control surface angle when fins 121 are selectively pivoted beyond exterior surface 112. Pivoting fins 121 beyond exterior surface 112 towards the extended position defines a range of control surface angles between control surface 124 and exterior surface 112. Greater control surface angles increase the tension on the web and cause web guide 100 to guide the web to a greater extent.

As demonstrated in FIGS. 5 and 7, fins 121 define a fin profile 125. Fin profile 125 is adapted to interface with a guide surface 134 of fin actuator 103. In particular, fin profile 125 includes a lobe 126 adapted to travel along guide surface 134 as fin actuator 103 translates a cam 130 axially relative to fins 121. Lobe 126 traveling along guide surface 134 selectively pivots fins 121 between the retracted position and the extended position.

In the example shown in FIGS. 2 and 5, control surface assembly 102 includes eight fins 121. Correspondingly, roller 101 defines eight slots 113 through which the eight fins 121 may extend. However, the web guides may include fewer or additional fins and slots, such as a single fin and slot, between two and seven fin and slot pairs, or more than eight fin and slot pairs.

The size and shape of the fins may vary in different examples. For example, the fins may be larger or smaller than the other web guide components than depicted in FIGS. 1-7. In the present example, control surfaces 124 are flat. However, the control surfaces could be curved, ridged, or discontinuous in other examples.

Fin Actuator

Fin actuator 103 is configured to selectively move fins 121 between the retracted position and the extended position. In particular, fin actuator 103 is configured to selectively pivot fins 121 between the retracted position and the extended position by engaging lobes 126 when fin actuator 103 moves axially relative to fins 121.

The reader can see in FIGS. 1-4 and 7 that fin actuator 103 is coaxially arranged with roller 101 and control surface assembly 102. Fin actuator 103 is selectively disposed within control surface assembly 102 by axially translating relative to control surface assembly 102. When fin actuator 103 is disposed within control surface assembly 102, fin actuator 103 is also disposed inside roller 101.

As shown in FIGS. 1-3, 6, and 7, fin actuator 103 includes a cam 130 and a linear actuator 131. The components of fin actuator 130 are described in the sections below.

Other mechanisms for selectively moving the fins between the retracted position and the extended positions are contemplated. For example, the fins may be selectively raised and lowered via a mechanism including a pneumatic reservoir and pump assembly. Additionally or alternatively, Individual motorized actuators could control fin motion.

Cam

Cam 130 functions to selectively pivot fins 121 between the retracted position and the extended position. Cam 130 selectively pivots fins 121 between the retracted position and the extended position by engaging lobes 126 when linear actuator 131 moves cam 130 axially relative to fins 121.

As shown in FIG. 1, cam 130 is mounted to linear actuator 131 and is selectively translated axially by linear actuator 131. Cam 130 includes a cam shaft 132 mounted to linear actuator 131. Cam 130 further includes a guide member 133 mounted to cam shaft 132.

As shown in FIGS. 1-3 and 6, guide member 133 defines guide slots 137. Guide slots 137 are complementarily configured with fins 121 and aligned with fins 121. Accordingly, fins 121 can pass through slots 137 as cam 130 axially translates relative to fins 121.

As shown in FIGS. 1-3, 6, and 7, guide slots 137 define guide surfaces 134. Guide surfaces 134 are configured to pivot fins 121 between the retracted position and the extended position. Guide surfaces 134 pivot fins 121 by engaging lobes 126 as guide member 133 moves axially relative to lobes 126 in response to liner actuator 131 axially translating cam 130.

As can be seen in FIG. 7, guide surfaces 134 are tapered. Guide surfaces include a leading end 135 and a trailing end 136. Leading end 135 is proximate base member 120 and trailing end 136 is disposed opposite leading end 135 and distal base member 120. FIG. 7 demonstrates that the height of leading end 135 is less than the height of trailing end 136.

Linear Actuator

Linear actuator 131 is configured to translate cam 130 relative to control surface assembly 102. Linear actuator 131 translating cam 130 towards base member 120 pivots fins 121 between the retracted position and the extended position. As shown in FIG. 1, linear actuator 131 supports cam 130 by cam shaft 132.

As further shown in FIG. 1, linear actuator 131 is controllably coupled to control unit 151. Control unit 151 dynamically directs linear actuator 131 to axially translate cam 130 towards base member 120 and away from base member 120 in response to sensor inputs received from web sensor 152. For example, control unit 151 may direct linear actuator 131 to move cam 130 towards base member 120 to raise fins 121 when inputs from web sensor 152 indicate that the web is tracking away from the longitudinal center of roller 101 instead of along a desired tracking path centered on roller 101.

The linear actuator may be any currently known or later developed type of linear actuator. In some examples, the linear actuator pneumatically, electrically, or magnetically translates the cam. Any suitable means for translating the cam may be utilized by the linear actuator. The size and shape of the linear actuator may be different than depicted in FIG. 1.

Web Guide System

Web guide system 150 functions to dynamically guide a web with web guide 100 based on detected tracking behavior of the web over roller 101. The detected position of the web relative to roller 101 at a given time is used by control unit 151 to dynamically instruct linear actuator 131 to translate cam 130 to modify the effective diameter of web guide 100 as necessary to guide the web along a desired path. As shown in FIG. 1, web guide system 150 includes web guide 100, a control unit 151, and a web sensor 152.

Web sensor 152 detects the tracking behavior of the web dynamically. Web sensor 152 supplies control unit 151 with sensor inputs, which correspond to the tracking behavior of the web as dynamically detected by web sensor 152. Web sensor 152 is in wireless data communication with control unit 151, but may be in wired data communication in other examples.

The web sensor may be any currently known or later developed type of sensor adapted to detect the position or tracking behavior of a web in a web machine. Suitable web sensors include infrared edge sensors, ultrasonic edge sensors, capacitive sensors, and optical sensors.

Control unit 151 dynamically instructs linear actuator 131 to translate cam 130 to modify the effective diameter of web guide 100 as necessary to guide the web along a desired path. Control unit 151 utilizes sensor inputs from web sensor 152 to dynamically determine instructions for linear actuator 131. The control unit may be any currently known or later developed type of controller suitable for translating cams.

Second Embodiment

Turning attention to FIGS. 8-10, a second example of a web guide, web guide 200, will now be described. Web guide 200 includes many similar or identical features to web guide 100. Thus, for the sake of brevity, each feature of web guide 200 is not redundantly explained. Rather, key distinctions between web guide 200 and web guide 100 are highlighted, and the reader should reference the discussion above for features substantially similar between the different web guide examples.

With reference to FIGS. 8-10, web guide 200 includes a roller (not pictured), a control surface assembly 202, and a fin actuator 203. Like web guide 100, web guide 200 functions guide a web moving over the roller by changing the effective diameter of the roller. Fins 221 of control surface assembly 202 changes the effective diameter of the roller when fins 221 are moved by fin actuator 203. Fin actuator 203 moves fins 221 between a retracted position shown in FIG. 9 and an extended position shown in FIG. 10.

Fin actuator 203 is configured differently than fin actuator 103. Whereas fin actuator 103 pivoted fins 121 with cam 130 and linear actuator 131, fin actuator 203 pivots fins 221 with a linkage 230 and a linear actuator (not pictured). Linkage 230 is pivotally coupled to fins 221 and extends and retracts fins 221 in response to being translated axially by the linear actuator.

As shown in FIGS. 8-10, linkage 230 includes a shaft 232, a hub 234, and pivot links 233. Shaft 232 is translated axially by the linear actuator. Hub 234 is mounted on shaft 232 and translates axially when shaft 232 is translated axially by the linear actuator.

Pivot links 233 are pivotally coupled to hub 234 around a radial periphery of hub 234. Pivot links 233 further pivotally couple to fins 221. When the linear actuator axially translates hub 234 away from the pivotal connection point between pivot links 233 and fins 221, fins 221 are pulled by pivot links 233 toward the retracted position shown in FIG. 9. When the linear actuator axially translates hub 234 towards the pivotal connection point between pivot links 233 and fins 221, fins 221 are pushed by pivot links 233 towards the extended position shown in FIG. 10.

The length of the pivot links may be different than shown in FIGS. 8-10 in other examples. Longer pivot links may be selected to increase the range of motion of the fins and to thereby increase the effective diameter range of the web guide. Shorter pivot links may be selected to decrease the range of motion of the fins and to thereby decrease the effective diameter range of the web guide.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A web guide, comprising:

a roller configured to mount to a drive shaft, the roller including a tube wall defining:

an interior space radially surrounded by the tube wall;

an exterior surface that supports a web and that defines an exterior surface diameter perpendicular to an axis of the roller; and slots circumferentially spaced around the tube wall, the slots passing through the tube wall from the interior space to the exterior surface;

a control surface assembly disposed within the interior space, the control surface assembly including fins aligned with the slots and adapted to selectively move through the slots between a retracted position contained within the interior space of the roller and an extended position protruding beyond the exterior surface of the roller; and a fin actuator configured to selectively move the fins between the retracted position and the extended position;

wherein:

each fin includes a control surface configured to contact and guide a web when the fins are selectively moved to protrude beyond the exterior surface of the roller;

the control surfaces of the fins collectively define a circumferential control surface extending around the roller and adapted to support and guide a web in place of a portion of the exterior surface from a plurality of radial positions around the tube wall;

the circumferential control surface defines a control surface diameter perpendicular to the axis of the roller; and the control surface diameter exceeds the exterior surface diameter by a variable amount based on how far the fins protrude beyond the exterior surface of the roller.

2. The web guide of claim 1, wherein:

the roller, the control surface assembly, and the fin actuator are coaxially arranged with the control surface assembly radially disposed between the roller and the fin actuator; and the control surface assembly is radially surrounded by the tube wall.

3. The web guide of claim 1, wherein:
the control surface assembly includes a base member;
the fins are pivotally mounted to the base member; and
the fin actuator is configured to selectively pivot the fins between the retracted position and the extended position.

4. The web guide of claim 3, wherein pivoting the fins beyond the exterior surface guides the web to a degree proportionate to how much the fins extend beyond the exterior surface.

5. The web guide of claim 3, wherein the control surface defines a variable effective diameter of the roller when the fins are selectively pivoted beyond the exterior surface of the roller.

6. The web guide of claim 3, wherein the control surface is flat.

7. The web guide of claim 3, wherein the control surface is oriented transverse to the exterior surface at a control surface angle when the fins are selectively pivoted beyond the exterior surface.

8. The web guide of claim 7, wherein pivoting the fins beyond the exterior surface towards the extended position defines a range of control surface angles between the control surface and the exterior surface.

9. The web guide of claim 3, wherein the fin actuator includes a cam configured to selectively pivot the fins between the retracted position and the extended position.

10. The web guide of claim 9, wherein the fin actuator includes a linear actuator configured to translate the cam relative to the control surface assembly.

11. The web guide of claim 10, wherein the linear actuator translating the cam towards the base member pivots the fins between the retracted position and the extended position.

12. The web guide of claim 11, wherein the cam defines a guide surface configured to pivot the fins between the retracted position and the extended position.

13. The web guide of claim 12, wherein:
the cam defines guide slots formed in the cam;
the guide slots are complementarily configured with the fins and aligned with the fins; and
the guide surface is defined by floors of the guide slots.

14. The web guide of claim 12 wherein the guide surface is tapered.

15. The web guide of claim 14, wherein:
the guide surface includes a leading end proximate the base member and a trailing end opposite the leading end and distal the base member; and
the height of the leading end is less than the height of the trailing end.

16. The web guide of claim 12, wherein the fins define a fin profile adapted to interface with the guide surface to selectively pivot the fins between the retracted position and the extended position.

17. The web guide of claim 16, wherein the fin profile includes a lobe adapted to travel along the guide surface.

18. A web guide, comprising:
a roller configured to mount to a drive shaft, the roller including a tube wall defining:
an interior space radially surrounded by the tube wall;
an exterior surface; and
slots circumferentially spaced around the tube wall, the slots passing through the tube wall from the interior space to the exterior surface;
a control surface assembly disposed within the interior space, the control surface assembly including fins aligned with the slots and adapted to selectively move through the slots between a retracted position contained within the interior space of the roller and an extended position protruding beyond the exterior surface of the roller; and
a fin actuator configured to selectively move the fins between the retracted position and the extended position;
wherein:
the control surface assembly includes a base member;
the fins are pivotally mounted to the base member;
the fin actuator is configured to selectively pivot the fins between the retracted position and the extended position;
the fin actuator includes a cam configured to selectively pivot the fins between the retracted position and the extended position;
the fin actuator includes a linear actuator configured to translate the cam relative to the control surface assembly;
the linear actuator translating the cam towards the base member pivots the fins between the retracted position and the extended position;
the linear actuator is controllably coupled to a control unit;
the control unit receives web sensor inputs from a web sensor;
the web sensor is configured to dynamically detect tracking behavior of a web that is guided by the web guide; and
the web sensor inputs correspond to the tracking behavior of the web dynamically detected by the web sensor.

19. The web guide of claim 18, wherein the control unit dynamically controls the linear actuator to selectively translate the cam relative to the control surface assembly in response to the web sensor inputs to dynamically guide the web.

* * * * *